US007907101B2

(12) United States Patent
Ratajczak et al.

(10) Patent No.: US 7,907,101 B2
(45) Date of Patent: Mar. 15, 2011

(54) CONFIGURABLE BIPOLARIZATION REFLECTOR

(75) Inventors: Philippe Ratajczak, Nice (FR); Patrice Brachat, Nice (FR); Jean-Marc Fargeas, Mougins (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 12/087,028

(22) PCT Filed: Dec. 22, 2006

(86) PCT No.: PCT/FR2006/051418

§ 371 (c)(1),
(2), (4) Date: Oct. 13, 2009

(87) PCT Pub. No.: WO2007/074307

PCT Pub. Date: Jul. 5, 2007

(65) Prior Publication Data

US 2010/0045561 A1 Feb. 25, 2010

(30) Foreign Application Priority Data

Dec. 22, 2005 (FR) ..... 05 54010

(51) Int. Cl.
*H01Q 15/14* (2006.01)

(52) U.S. Cl. ..... 343/912; 343/913

(58) Field of Classification Search ..... 343/912, 343/913, 914, 876, 834, 840
See application file for complete search history.

(56) References Cited

U.S. PATENT DOCUMENTS

| | | | | |
|---|---|---|---|---|
| 4,918,459 | A * | 4/1990 | De Teso | 343/872 |
| 5,001,495 | A | 3/1991 | Chekroun et al. | |
| 5,621,423 | A | 4/1997 | Sureau et al. | |
| 6,323,809 | B1 | 11/2001 | Maloney et al. | |
| 6,501,427 | B1 | 12/2002 | Lilly et al. | |
| 6,909,729 | B2 * | 6/2005 | Ibanescu et al. | 372/6 |
| 7,123,205 | B2 * | 10/2006 | Ratajczak et al. | 343/773 |
| 2010/0263709 | A1 * | 10/2010 | Norman et al. | 136/246 |

FOREIGN PATENT DOCUMENTS

| | | |
|---|---|---|
| FR | 2 863 109 | 6/2005 |

* cited by examiner

*Primary Examiner* — HoangAnh T Le
(74) *Attorney, Agent, or Firm* — Cohen Pontani Lieberman & Pavane LLP

(57) ABSTRACT

A configurable bipolarization reflector comprises intersecting first and second sets of parallel composite lines ($LH_i$, $LV_j$), a line segment between two consecutive intersection points ($I_{ij}$) of the two sets containing a component (12) having conductivity that can be switched by a switching signal (V). The components are disposed on the line segments so that a switching signal applied at a point of intersection ($P_{1k}$, $P_{1k'}$, $P_{1k''}$) of said sets switches the conductivity of the components of a group of segments defining a reflector area (Z) of given reflectivity.

10 Claims, 2 Drawing Sheets

• unbiased lines
× short-circuited lines

CONFIGURABLE BIPOLARIZATION REFLECTOR

RELATED APPLICATIONS

This is a U.S. national stage under 35 USC 371 of application No. PCT/FR2006/051418, filed on Dec. 22, 2006.

This application claims the priority of French patent application no. 05/54010 filed Dec. 22, 2005, the content of which is hereby incorporated by reference.

FIELD OF THE INVENTION

The present invention relates to a configurable bipolarization reflector.

The invention finds a particularly advantageous application in the field of mobile telephony in the GSM (Global System for Mobile Communication), DCS (Digital Cellular System), and UMTS (Universal Mobile Telecommunications system) bands and in the field of distributing WLAN (Wireless Local Area Network), WiFi, LMDS (Local Multi-point Distribution System), and even UWB (Ultra Wide Band) high bit rate services.

BACKGROUND OF THE INVENTION

Here references to the configurability of a reflector refer to the possibility of intentionally modifying its spatial coverage by adjusting the configuration of the radiation transmitted or received in one or more areas of given direction and width by selectively controlling the reflectivity properties of the reflector. With this type of reflector, it is possible in particular to define configurable multibeam or single-beam antennas.

Clearly, given the multiplicity of mobile telephone systems and high bit rate distribution services, the ability to configure a reflector can impact on the number of antennas on the same site. As a function of the required coverage, the antenna can be configured to obtain radiation in a larger or smaller cell or to illuminate a plurality of cells in different angular sectors. Thus coverages can be modified without changing antennas or their positions. Associated with a configurable reflector, the antenna can be a broadband or multiband antenna.

In areas where there is little interference, in particular in a rural environment, reflectors and associated antennas process only the vertical component of the electromagnetic radiation, the horizontal component being of no particular interest.

However, in urban areas where electromagnetic radiation is liable to suffer numerous kinds of interference, such as unwanted reflections, it is advantageous to be able to process vertical polarization and horizontal polarization simultaneously so as to be able to recover whichever of the two signals has the higher power.

With frequency selective surfaces (FSS), tackling reflection problems by processing two orthogonal polarizations has been addressed by the production of cruciform dipole arrays producing the same reflection coefficient in both polarization directions (see V. A. Agrawal, W. A. Imbriale, "Design of a Dichroic Cassegrain Subreflector", IEEE Trans. on Antennas and Propagation, vol. AP-27, No. 4, pp. 466-473, July 1979). In these FSS applications, the geometrical properties of the array, such as its period and its geometrical shape, generate resonances in which the electromagnetic field is reflected or transmitted, and the surface concerned is then reflective or transparent. FSS are mainly used in applications employing multiband reflector antennas because these FSS use a single main reflector associated, as a function of frequency band, with a plurality of sources that are not placed at the same location but that, by means of different FSS type subreflectors, direct the electromagnetic field onto the main reflector whilst being transparent outside its operating band. There is therefore no phenomenon of masking if radiation in one frequency band intercepts a sub-reflector of another frequency band.

However, although they can take account of both types of polarization, these reflectors are not configurable in that they do not have exactly the same reflectivity for both polarizations in the same area.

To obtain a configurable FSS reflector, the paper by J. A. Bossard, D. H. Werner, T. S. Mayer, R. P. Drupp, "A Novel Design Technology for Reconfigurable Frequency Selective Surface using Genetic Algorithms", IEEE Trans. on Antennas and Propagation, vol. AP-53, No. 4, pp 1390-1399, April 2005, proposes introducing switchable elements between each end of the crosses in order to produce an array of two sets of composite parallel lines intersecting at 90° and comprising discontinuous conductive strips separated by a component whose conductivity can be switched by application of a switching signal, such as a DC voltage, with switchable components consisting of PIN diodes. Accordingly, by imposing a given conduction state on the line segments between two consecutive intersection points of the array, it is possible to define runs of a plurality of vertical and horizontal segments having a given reflectivity. This results in a variation of the size of the basic pattern of the array, enabling the FSS resonant frequency to be adjusted in use, without it being necessary to change FSS. To modify the geometrical characteristics, it suffices to switch appropriately only some of the components.

However, the above-mentioned paper does not provide any information about how to apply the switching signal to the components in practice, except for applying a signal individually to each component, which would result in extremely complex connections, possibly even incompatible with the constraint of maximizing transmission by the reflector.

Moreover, since the operation of those known FSS applications, with and without configurability of the basic pattern, is based on the resonance or non-resonance of the array, they rely on the shape of the pattern and the period of the array to reflect or transmit electromagnetic waves in narrow frequency bands.

SUMMARY OF THE INVENTION

One object of the invention is to provide a configurable bipolarization reflector, comprising first and second intersecting sets of parallel composite lines, a line segment between two consecutive intersection points of the two sets containing a component having conductivity that can be switched by a switching signal, and that can provide a very simple way in which to switch the switchable conductivity components so as to obtain any required reflector configuration over a wide frequency band while guaranteeing the best possible transmission.

This is achieved by a reflector according to an embodiment of the invention in which said components are disposed on the line segments so that a switching signal applied at a point of intersection of said sets switches the conductivity of the components of a group of segments defining a reflector area of given reflectivity.

Accordingly, by applying a single switching signal, it is possible to impose a given conductivity on the components of the segments of the same group and therefore to impose a given reflectivity state on the corresponding reflector area.

According to an embodiment of the invention, said point of application of said switching signal is preferably situated on a line external to said set.

In one particular embodiment of the reflector according to the invention, said switchable conductivity components are unidirectional conductivity components, the unidirectional conductivity components disposed along the lines of the first set have an alternating conductivity direction, and the unidirectional conductivity components of the lines of the second set have the same conductivity direction.

If the polarizations concerned are the vertical polarization and horizontal polarization of the same electromagnetic radiation, then according to an embodiment of the invention, the two sets of composite lines intersect at 90° and the length of the segments of the lines of the first set is equal to the length of the segments of the lines of the second set.

In contrast, if the polarizations concerned are a polarization of a first electromagnetic radiation and a different polarization of a second electromagnetic radiation, then, according to one advantageous embodiment of the invention, the length of the segments of the lines of the first set is different from the length of the segments of the lines of the second set, in the ratio of the wavelengths of the electromagnetic radiation. This can therefore limit the number of lines corresponding to the radiation with the longer wavelength.

In practice, said sets of lines are deposited on a support, such as a flexible dielectric material support, which is easily curved. This embodiment circumvents the selectivity linked to the use of FSS and extends the field of application of the reflector of the invention to widened frequency bands.

Reflector elements consisting of composite lines formed by conductive ribbons separated by components of switchable conductivity have been developed by the Fundamental Electronics Institute of Paris Sud-Orsay University (A. de Lustrac, T. Brillat, F. Gadot, E. Akmansoy, "Numerical and Experimental Demonstration of an Electronically Controllable PBG in the Frequency range 0 to 20 GHz", proceedings of the Antennas and Propagation Congress 2000, 9-14 Apr. 2000, Davos, Switzerland) with the aim of creating a multiple polarization metamaterial based on the principle of forbidden electromagnetic bands. The spatial distribution in two directions of the elements in a biperiodic array creates the equivalent of a crystal. The effect of this pseudo-crystal on the propagation of electromagnetic waves is modified by the presence of internal defects, which for some frequency bands produce transmission through the crystal for both polarizations although, had the crystal been perfect, it would have reflected all frequencies. These two complementary behaviors, reflecting when the switchable components are conducting and transparent when they are not, are obtained in the first prohibited electromagnetic energy band. As the frequency increases, these two behaviors can be interchanged compared to the switching of the components as a function of the appearance of the various prohibited bands that depend on the geometrical characteristics of the array: lengths of the segments in each direction, spatial distribution, equivalent impedances of the switched or non-switched components.

Finally, the flexible and curvable nature of the support offers the possibility of integrating the reflector of the invention into a large number of antennas. In particular, an embodiment of the invention provides an antenna noteworthy in that it includes a plurality of concentric cylindrical reflectors. The antennas concerned are in particular biconical antennas.

BRIEF DESCRIPTION OF THE DRAWINGS

FIGS. 1*a* and 1*b* show an element 10 of a composite line for implementing a configurable bipolarization reflector of the invention.

This element 10 is a substantially rectilinear, discontinuous ribbon 11 made from a conductive material, in particular a metal. A component 12 having an electrical conductivity that can be switched by a switching signal is inserted between two consecutive sections of ribbon. In FIGS. 1*a* and 1*b*, the components 12 are PIN diodes whose conduction state can be switched by a signal consisting of a DC voltage. Other components could be used, of course, such as suitably biased transistors.

In FIG. 1*a*, a DC voltage is applied to the terminals of the line element 10. Because of their very low resistance, the diodes 12 conduct, so that from the electrical point of view the element 10 behaves like a single conductive ribbon (10' in FIG. 1*a*). The element 10' therefore reflects electromagnetic waves.

Figure 1A:
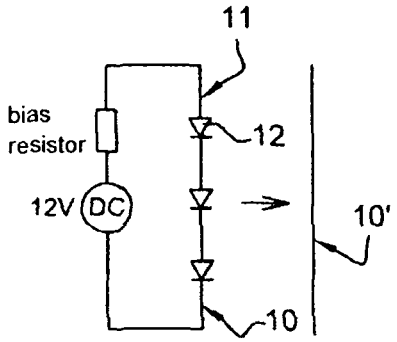
FIG. 1*a* represents an element of a composite line used to produce a reflector of the invention, in the reflecting state.
Figure 1B:
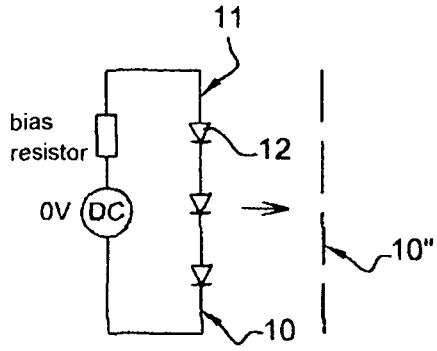
FIG. 1*b* represents the line element from FIG. 1*a* in the transparent state.

Conversely, in FIG. 1*b*, the diodes 12 are not biased and therefore have a high impedance. There is no electrical connection between the sections of the ribbon 11 and the equivalent element 10" is electromagnetically transparent. In practice, to limit interference, it is preferable for the length of a section of ribbon to be less than one fifth of the shortest wavelength used. It is then a very simple matter, by switching the bias voltage applied to the diodes, to modify the electromagnetic wave reflectivity of a composite line consisting of elements analogous to the element 10 from FIGS. 1*a* and 1*b*.

However, it must be emphasized that only the polarization parallel to the ribbon 11 is sensitive to the presence of the element 10 and to the conduction state of the diodes 12. The polarization perpendicular to the ribbon 11 is not affected because the width of the ribbon is very much smaller than the wavelength of the electromagnetic radiation used in the applications envisaged.

Figure 2:
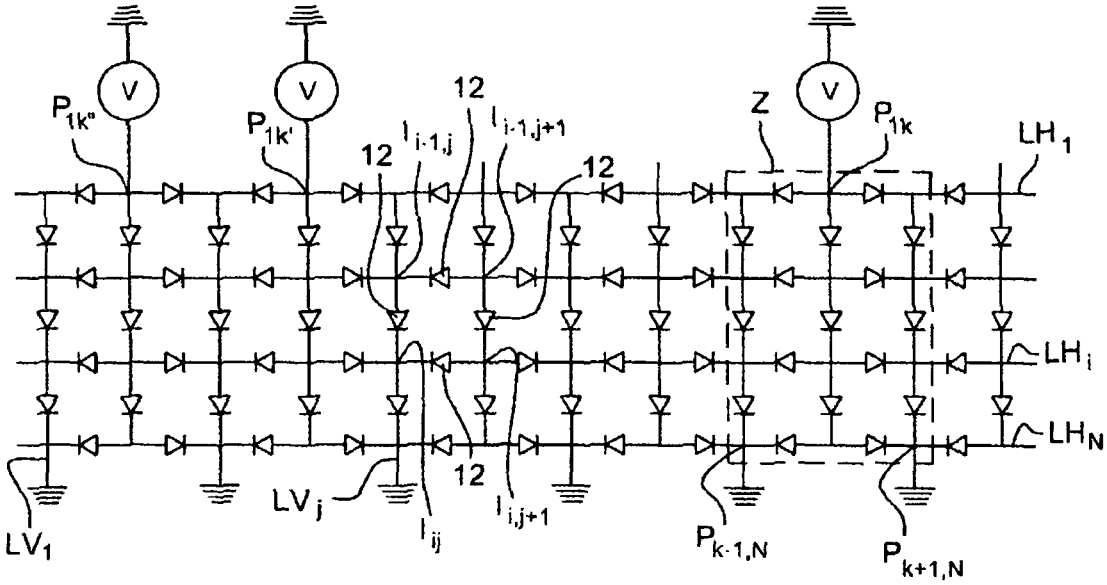
FIG. 2 is a front view of a configurable bipolarization reflector according to an embodiment of the invention.

To obtain configurable reflectivity for both polarizations, the FIG. 2 reflector structure is proposed.

As FIG. 2 indicates, this structure comprises two intersecting sets of parallel composite lines, namely horizontal lines $LH_i$ and vertical lines $LV_j$. Like the element 10 in FIGS. 1*a* and 1*b*, each horizontal or vertical line is a discontinuous conductive ribbon having sections that are connected by PIN diodes or, more generally, by components 12 having conductivity that can be switched. Each line segment between two consecutive intersection points, such as the intersection points $I_{ij}$, $I_{i-1,j}$, $I_{i,j+1}$ and $I_{i-1,j+1}$ in FIG. 2, contains a switchable component 12.

In the FIG. 2 example, the switchable diodes 12 in each horizontal line $LH_i$ are disposed so as to have a conduction direction alternating from one segment to another. In contrast, the diodes 12 in each vertical line $LV_j$ have the same conduction direction.

This reflector structure defines groups of line segments consisting of areas Z of given reflectivity, or base areas, when a switching voltage V is applied to a chosen intersection point of the alternating points on the exterior horizontal line $LH_1$, such as the points $P_{1k}$, $P_{1k'}$, and $P_{1k''}$ in FIG. 2, the ground connection being made to points $P_{k-1,N}$, $P_{k+1,N}$ of intersection on the exterior horizontal line $LH_N$, on the side opposite the line $LH_1$, with vertical lines alternating relative to the vertical lines including the points of application of the switching voltage V.

Accordingly, the base composite area Z is formed of three discontinuous vertical runs and horizontal segments connecting the horizontal runs via PIN diodes. The reverse parallel connection of the diodes in the horizontal run compared to the axis of vertical symmetry of the base area modifies only the reflectivity state of the base area, without modifying that of the adjacent areas, as the horizontal diodes connecting them are reverse-biased. This base element is energized in a quincunx arrangement:

- the vertical run to the end of which the switching voltage V is applied is not connected to ground at its other end in order to force biasing of the horizontal diodes by closing the circuit to the other adjacent vertical runs;
- energization of the central vertical run automatically polarizes the adjacent vertical runs and all the horizontal segments connected to them.

It should be noted that the shape and/or size of the base area Z can be chosen at will. It suffices to dispose the components 12 on the segments in an appropriate conduction direction to obtain a group of segments having the same conductivity when they are subjected to the same switching signal.

The operating principle is then as follows:

- applying a DC switching voltage short-circuits the diodes whose conduction direction is the forward direction and thus produces a single continuous run of greater length which, for the polarization parallel to the run, is electromagnetically reflecting, according to the FIG. 1*a* diagram. With the reflector from FIG. 2, the biasing of the diodes short-circuits the vertical and horizontal lines at the same time, so that both the horizontal and the vertical polarizations of the field are reflected;
- if the diodes are not biased, they have a very high impedance. The segments between intersection points are open-circuit, and if their individual length is also well chosen, the corresponding base area Z remains transparent to the electromagnetic waves. As mentioned above, to minimize interference, this individual length is preferably less than one fifth of the shortest wavelength.

Figure 3:
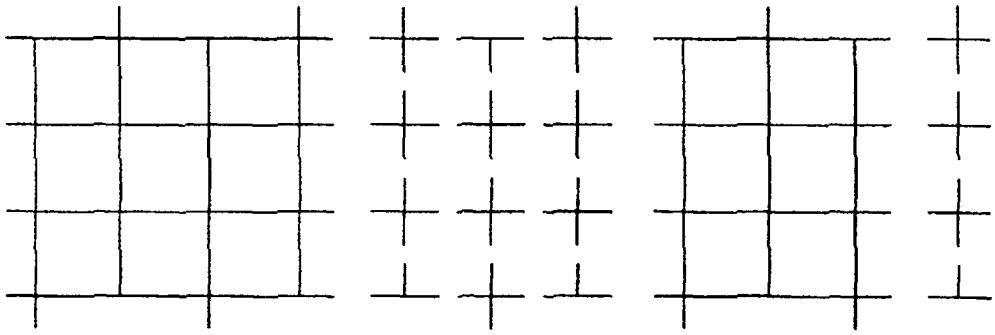
FIG. 3 shows one example of reflectivity configuration obtained with the reflector from FIG. 3.

FIG. 3 shows an example of a reflectivity configuration obtained with the reflector from FIG. 2. On the left-hand portion of the reflector there are two adjacent base areas simultaneously reflecting horizontal and vertical polarizations because of the application of the switching voltage V to the points $P_{1k''}$ and $P_{1k'}$. Both these reflecting areas adjoin two base areas transparent to the two polarizations, no switching voltage being applied to these areas. A new base area is then rendered reflective by applying a switching voltage V to the point $P_{1k}$. And so on.

In FIGS. 2 and 3, the segments have the same length in both the horizontal and the vertical directions. This structure is very suitable for simultaneously processing horizontal and vertical polarization of electromagnetic radiation of given wavelength.

When processing the horizontal polarization of first electromagnetic radiation and the vertical polarization of second electromagnetic radiation, it may be advantageous for the segments to have different lengths. For example, for radiation at 1 GHz (GSM) and at 2 GHz (UMTS), it is possible to make the segments twice as long in the direction of polarization of the radiation at 1 GHz, which is reflected in half the number of corresponding composite lines.

The reflector of the invention can be produced by printing metal ribbons onto a plane or shaped dielectric support, the diodes being soldered to the ends of the ribbons.

It can equally be produced on a rigid support of any shape, in particular a cylindrical foam support machined according to the required array of lines and onto which copper is deposited.

This produces a configurable material that can be used to produce either reflectors or electromagnetically transparent windows, as a function of the intended application.

This material that is reflecting or transparent in the same area for the two polarizations of the radiation can be associated with an antenna for:

- controlling the radiation as a function of the coverage areas in which the antenna must be transparent or reflective;
- using it as an electromagnetic window when all the layer of material is transparent or reflecting, in order to mask the antenna when it is not transmitting.

The configurable bipolarization reflector structure on a flexible support produces cylindrical reflectors very easily. As both polarizations are controlled via a single port parallel to the axis of the cylinder, it suffices to close the plane support on itself to obtain a cylindrical structure and to connect the horizontal lines appropriately to drive the base area(s) over 360° with no connection.

One particular application of the invention produces a configurable mono-multibeam antenna by associating cylindrical configurable bipolarization reflectors regularly distributed over concentric circles at the center of which a bipolarization omnidirectional electromagnetic source is placed.

Figure 4:
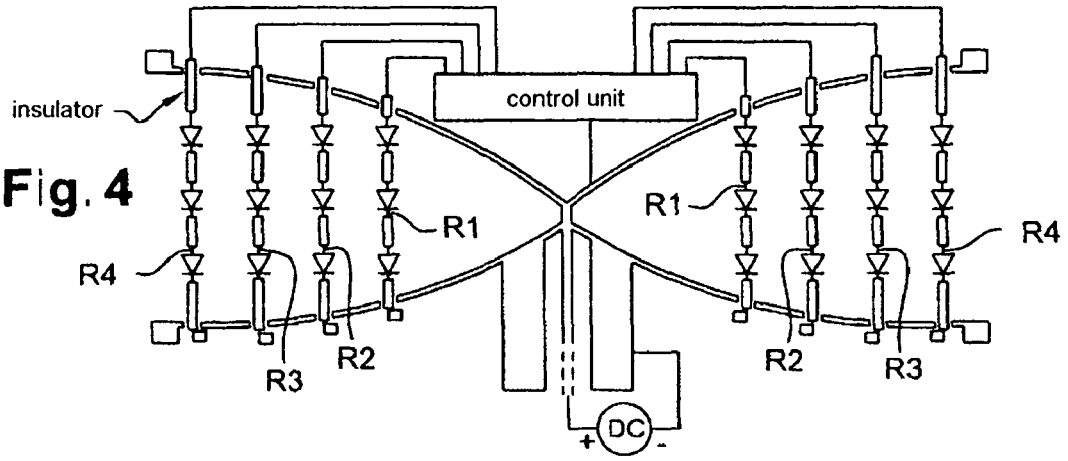
FIG. 4 is a view in section of a biconical antenna comprising a plurality of reflectors according to an embodiment of the invention.

FIG. 4 shows by way of example a biconical antenna comprising four cylindrical reflectors R1 to R4.

Figure 5A:
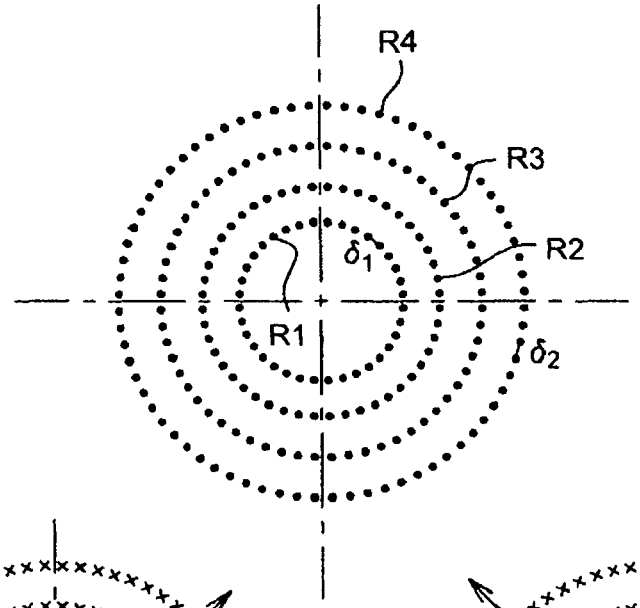
FIG. 5*a* is a plan view of the distribution of the reflectors of the antenna from FIG. 4.

As FIG. 5*a* shows, the angular distribution of the vertical lines varies as a function of the radius of the positioning circle in order to obtain a constant pitch δ at the perimeter and an appropriate number of lines to close the array on itself.

Figure 5B:
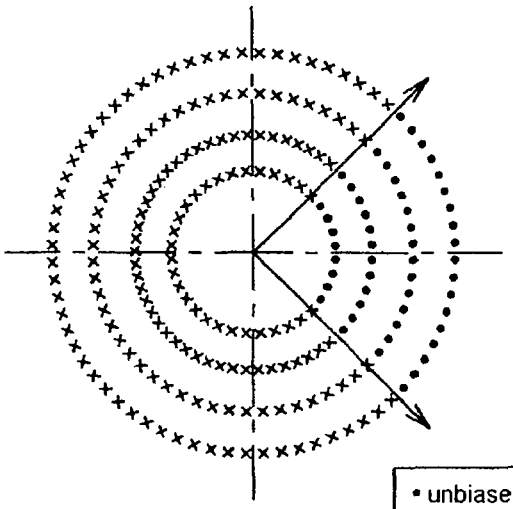
FIG. 5*b* represents the FIG. 5*a* distribution with a single-beam polarization reflector configuration.
Figure 5C:
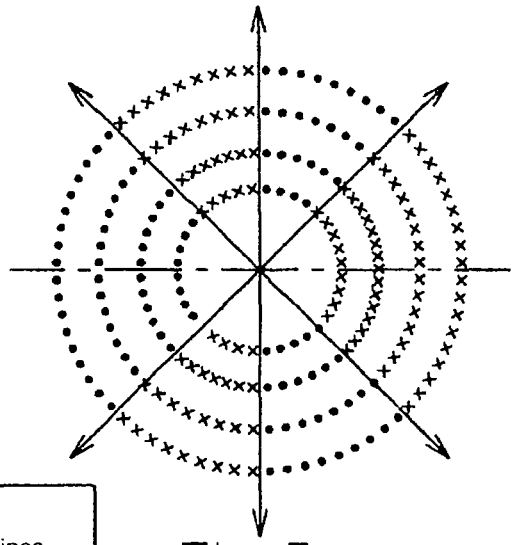
FIG. 5*c* represents the FIG. 5*a* distribution in a multi-beam polarization reflector configuration.

As a function of the lines that are polarized or not, the required field distribution can be obtained for both polarizations simultaneously:

- single-beam of variable width, as in FIG. 5*b;*
- multibeam with the width of each beam variable, as in FIG. 5*c*.

The invention claimed is:

1. A configurable bipolarization reflector comprising:

first and second intersecting sets of parallel composite lines ($LH_i$, $LV_j$), a line segment between two consecutive intersection points ($I_{ij}$) of the first and second intersecting sets of parallel composite lines containing a switchable conductivity component (12) having conductivity that can be switched by a switching signal (V), wherein the switchable conductivity components disposed on the segments along the lines ($LH_i$) of the first set present an alternating conductivity direction, and the switchable conductivity components disposed on the segments along the lines ($LV_j$) of the second set present the same conductivity direction; and means for applying a switching signal (V) in order to switch the conductivity of the components of a group of segments defining a reflector area (Z) of given reflectivity, wherein the switching signal (V) is applied between:

firstly, a first point ($P_{1k}$) of intersection of said first and second intersecting sets of parallel composite lines situated on a first outermost line ($LH_1$) of said first set and a line ($LV_k$) of the second set, the switchable conductivity components (12) of the segments adjoining said intersection point ($P_{1k}$) being conductive in response to the switching signal (V); and secondly, two second points ($P_{k-1,N}$, $P_{k+1,N}$) of intersection of said first and second intersecting sets of parallel composite lines situated on a second outermost line ($LH_N$) of said first set, on the side opposite the first line ($LH_1$), and on two lines ($LV_{k-1}$, $LV_{k+1}$) adjoining the line ($LV_k$) of application of the first point ($P_{1k}$) of intersection.

2. The reflector according to claim 1, wherein said switchable conductivity components are unidirectional conductivity components (12).

3. The reflector according to claim 1, wherein the length of the segments of the lines of the first set is equal to the length of the segments of the lines of the second set.

4. The reflector according to claim 1, wherein the length of the segments of the lines of the first set is different from the length of the segments of the lines of the second set.

5. The reflector according to claim 1, wherein said sets of lines are deposited on a support.

6. The reflector according to claim 5, wherein said support is flexible.

7. The reflector according to claim 5, wherein said support is rigid.

8. A configurable antenna, comprising a reflector according to claim 1.

9. The antenna according to claim 8, comprising a plurality of concentric cylindrical reflectors (R1, R2, R3, R4).

10. A configurable bipolarization reflector comprising first and second intersecting sets of parallel composite lines ($LH_i$, $LV_j$), a line segment between two consecutive intersection points ($I_{ij}$) of the two sets containing a component (12) having conductivity that can be switched by a switching signal (V), the reflector being characterized in that the switchable conductivity components disposed on the segments along the lines ($LH_i$) of the first set present an alternating conductivity direction, in that the switchable conductivity components disposed on the segments along the lines ($LV_j$) of the second set present the same conductivity direction, and in that a switching signal (V) applied between:

firstly a first point ($P_{1k}$) of intersection of said sets situated on a first outermost line ($LH_1$) of said first set and a line ($LV_k$) of the second set, the switchable conductivity components (12) of the segments adjoining said intersection point ($P_{1k}$) being conductive vis-à-vis the switching signal (V); and secondly two second points ($P_{k-1,N}$, $P_{k+1,N}$) of intersection of said sets situated on a second outermost line ($LH_N$) of said first set, on the side opposite the first line ($LH_1$), and on two lines ($LV_{k-1}$, $LV_{k+1}$) adjoining the line ($LV_k$) of application of the first point ($P_{1k}$) of intersection;

switches the conductivity of the components of a group of segments defining a reflector area (Z) of given reflectivity.

* * * * *